US006202532B1

(12) United States Patent
Kadushin

(10) Patent No.: US 6,202,532 B1
(45) Date of Patent: Mar. 20, 2001

(54) DATA EXCHANGE SYSTEM AND METHOD FOR AMMUNITION ROUNDS

(75) Inventor: Issac Kadushin, Haifa (IL)

(73) Assignee: State of Israel - Ministry of Defense, Rafael - Armament Development Authority, Haifa (IL)

( * ) Notice: Subject to any disclaimer, the term of this patent is extended or adjusted under 35 U.S.C. 154(b) by 0 days.

(21) Appl. No.: 09/182,191

(22) Filed: Oct. 30, 1998

(30) Foreign Application Priority Data

Jan. 18, 1998 (IL) ..... 122963

(51) Int. Cl.[7] ..... F42C 17/00

(52) U.S. Cl. ..... 89/6.5; 89/6; 102/265; 102/270

(58) Field of Search ..... 89/6, 6.5; 102/265, 102/270, 472

(56) References Cited

U.S. PATENT DOCUMENTS 3,500,746 * 3/1970 Ambrosini ..... 102/70.2
3,814,017 * 6/1974 Backstein et al. ..... 102/70.2
4,015,531 * 4/1977 Ziemba ..... 102/70.2
4,033,266 * 7/1977 Ziemba ..... 102/70.2
4,993,322 * 2/1991 Boucard ..... 102/218
5,078,051 * 1/1992 Amundson ..... 102/206
5,097,765 * 3/1992 Ziemba ..... 102/218

* cited by examiner

*Primary Examiner*—Charles T. Jordan
*Assistant Examiner*—Michelle Thomson
(74) *Attorney, Agent, or Firm*—Mark M. Friedman

(57) ABSTRACT

In a weapons system of the type in which a round having a case is fired from a gun, the round including a fuze processor, the round further made up of a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun. A data exchange system for exchanging data between the fuze processor and the fire control system is made up of an electrical connection, within the round, between the contacts of the round and the fuze processor, the resistor being thereby connected in parallel with the fuze processor and a data exchange link, between the fire control system and the contacts of the gun, for applying, to the contacts of the gun, electrical signals representative of data transferred from the fire control system to the fuze processor.

25 Claims, 3 Drawing Sheets

DATA EXCHANGE SYSTEM AND METHOD FOR AMMUNITION ROUNDS

FIELD AND BACKGROUND OF THE INVENTION

The present invention relates to a system and method for exchanging data between a round of ammunition and a fire control system and, more particularly, to a system and method for doing so after the round has been loaded into a gun and is ready for firing.

Some modern "smart" ordinance including warheads and projectiles incorporate processor-based fuzes, sensors and similar devices which allow the behavior or the warheads and projectiles subsequent to launch to be programmed to behave according to instructions and data loaded into the processors before launch. For example, an explosive projectile can be programmed to explode at various times after launch, at various distances from the gun, or, if the fuze is provided with an appropriate proximity sensor, at various distances from the target. In the case of a round that is fired from a gun, this programming usually is done before the round is loaded into the gun for firing, by entering the appropriate data into the memory of the fuze. This data entry step is inconvenient in the heat of battle. In addition, if a reset is required, the round must be unloaded, reset, and reloaded.

There is thus a widely recognized need for, and it would be highly advantageous to have, a system and method for exchanging data between a fire control system of a gun and a "smart" round after the round has been loaded in the gun and is ready to fire, without unloading the round.

SUMMARY OF THE INVENTION

According to the present invention there is provided, in a weapons system of the type in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun: a data exchange system for exchanging data between the fuze processor and the fire control system, including: (a) an electrical connection, within the round, between the contacts of the round and the fuze processor, the resistor being thereby connected in parallel with the fuze processor; and (b) a data exchange link, between the fire control system and the contacts of the gun, for applying, to the contacts of the gun, electrical signals representative of data transferred from the fire control system to the fuze processor.

According to the present invention there is provided, in a weapons system of the type in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun: a method for exchanging data between the fuze processor and the fire control system while the round is inside the gun and before firing the gun, including the steps of: (a) providing a data exchange system including: (i) an electrical connection, within the round, between the contacts of the round and the fuze processor, the resistor being thereby connected in parallel with the fuze processor; and (ii) a data exchange link, between the fire control system and the contacts of the gun, for applying, to the contacts of the gun, electrical signals representative of data to be transferred from the fire control system to the fuze processor, and (b) transferring the data via the data exchange system.

Many modern artillery pieces are fired electrically. Contacts on the surface of the case of the round are connected in series with a resistor, termed herein the "firing resistor", inside the round. The case of the round is defined herein as that part of the round that contains the propellant and an electrical igniter of the propellant. The term "case" as used herein thus includes partial or "perishing" cases. When the round is loaded into the gun, these contacts are in contact with matching contacts in the breech of the gun. The gun is fired by applying a voltage to the contacts of the gun that is sufficiently high to heat the firing resistor to a temperature high enough to set off the charge that propels the shell out of the barrel of the gun. According to the present invention, an electrical circuit, called herein a "data exchange link", parallel to, and using the same contact points as, the firing circuit, is provided to exchange data between the fire control system and the round via the contacts of the gun. This electrical circuit includes a mechanism for ensuring that electrical signals, sent from the fire control system to the round and representative of data being transferred from the fire control system to the round, have a voltage less than a "no-fire" threshold voltage that is low enough to ensure that the gun does not fire. The microprocessor of the fuze or similar device inside the round, that controls the behavior of the round subsequent to firing, and which is referred to herein as the "fuze processor", is connected electrically in parallel with the firing resistor. It is to be understood that the term "fuse processor" includes within its scope any processor coupled to a sensor or similar device that is used to sense the environment of the round subsequent to launch.

The fuze processor interfaces with this parallel electrical connection via a communications control unit which requires an independent power supply. In one embodiment of the present invention, this power supply is based on batteries. In another embodiment of the present invention, this power supply includes a capacitor, a diode rectifier, and a transformer. The transformer is connected in parallel with the firing resistor, just as the communications control unit is connected in parallel with the firing resistor. The capacitor is charged, before data exchange, by applying an AC voltage less than the "no fire" threshold voltage to the contacts of the gun. A series of switches is used to sequentially charge the power supply, exchange data between the fire control system and the fuze processor, and then fire the gun.

The scope of the present invention includes all rounds, shells and projectiles, of whatever size, that are capable of being fired electrically from a gun.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a system and method for exchanging data between a fire control system and an electrically fired "smart" round of ammunition after the round has been loaded in a gun and is ready for firing.

The principles and operation of a smart weapons system according to the present invention may be better understood with reference to the drawings and the accompanying description.

Figure 1:
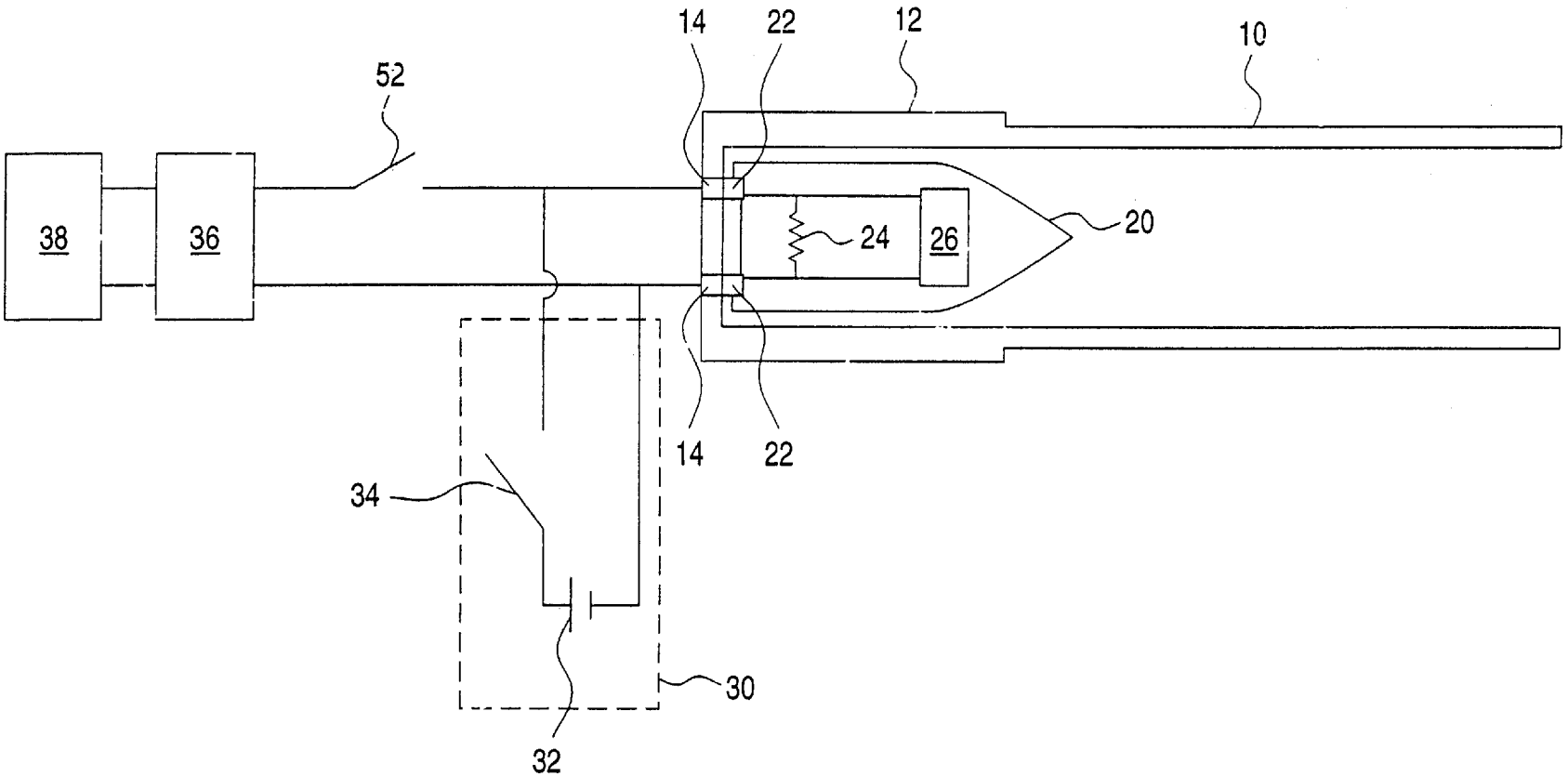
FIG. 1 is a schematic illustration of a weapons system incorporating the data exchange system of the present invention.

Referring now to the drawings, FIG. 1 is a schematic overall depiction of an illustrative weapons system incorporating the data exchange system of the present invention. An ammunition round 20 has been loaded in the breech 12 of a gun 10. Breech 12 includes electrical contacts 14. Round 20 includes electrical contacts 22 that are in contact with contacts 14 when round 20 has been loaded into gun 10 and is ready for firing. A firing resistor 24 is connected electrically to contacts 22. (A typical embodiment of firing resistor 24 is the bridgewire of an initiator cartridge.) An artillery round communications/control system 26 also is connected electrically to contacts 22, in parallel with firing resistor 24.

Two electrical circuits, outside of gun 10, are shown connected, in parallel, to contacts 14. One of these circuits is a firing circuit 30 that includes a voltage source 32 in series with a trigger switch 34. When trigger switch 34 is closed, voltage source 32 supplies a voltage across resistor 24 that exceeds the threshold needed to heat resistor 24 to a temperature sufficiently high to set off the propulsive charge inside round 20. In other words, gun 10 is fired by closing switch 34. The other circuit includes a fire control system 38, a data exchange link 36 for exchanging data between fire control system 38 and artillery round communications/control system 26, and a data exchange switch S2. When data exchange switch S2 is closed, data are exchanged between fire control system 38 and artillery round communications/control system 26, as described below. Preferably, these data are in the form of electrical pulses compatible with a standard digital communications system.

Because the firing circuit is in parallel with the second circuit, a weapons system that includes the data exchange system of the present invention can be used to fire either "smart" rounds or "dumb" rounds for which no data exchange is required.

Figure 2:
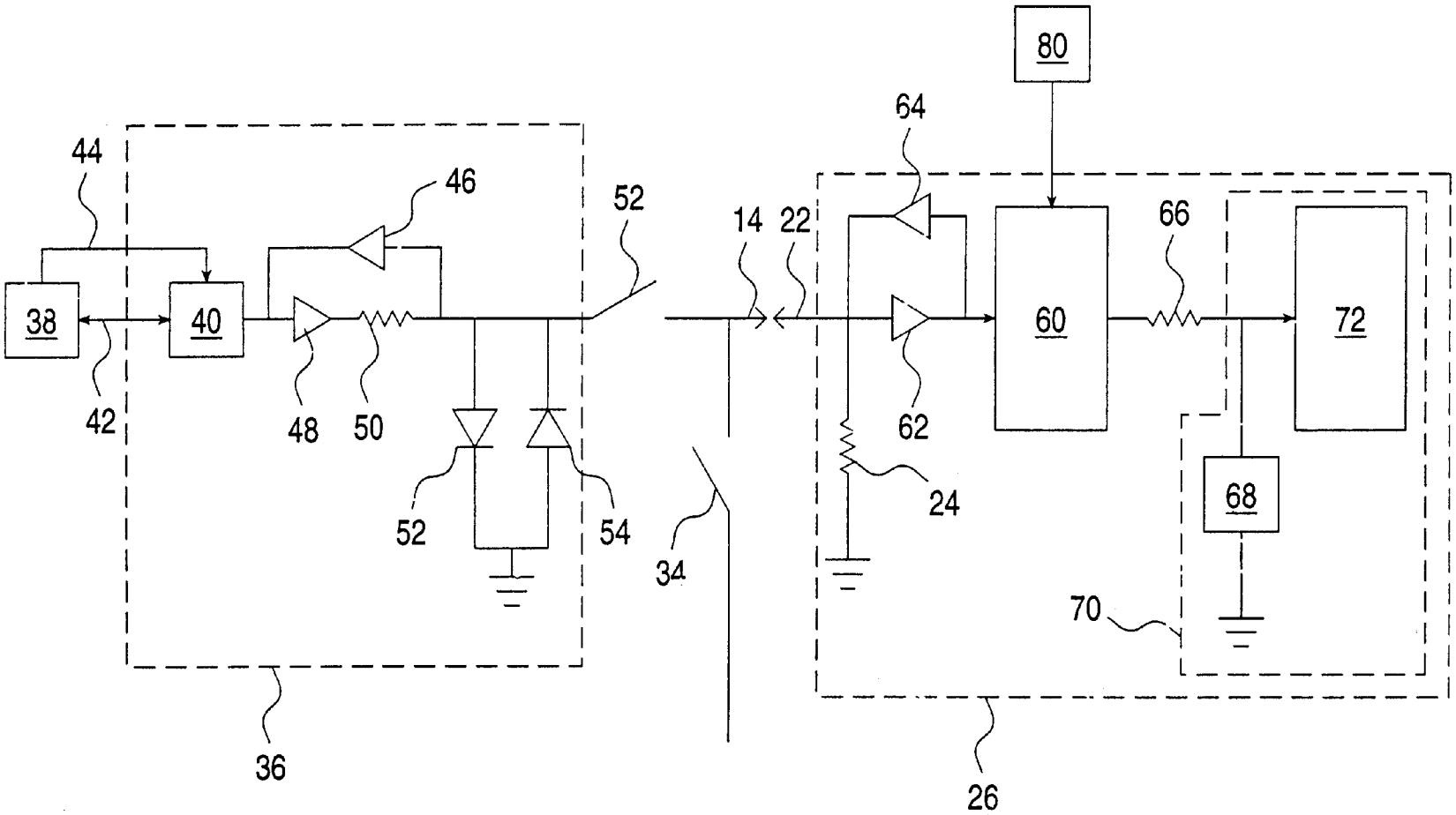
FIG. 2 is a schematic diagram of the data exchange system of the present invention.

FIG. 2 is a high level schematic diagram of the data exchange system of the present invention. Data exchange link 36 includes a communications control unit 40, including a standard communications microcontroller such as the 8051, which is available from Advanced Micro Devices of Sunnyvale Calif., inter alia, and associated circuitry to prevent voltages in excess of the "no fire" threshold from reaching round 20. This associated circuitry includes an amplifier 46 in parallel with an attenuator 48 and a resistor 50. High voltage signals from communications control unit 40 to round 20 are attenuated by attenuator 48 and resistor 50. Low voltage signals from round 20 to communications control unit 40 are amplified by amplifier 46. The associated circuitry further includes parallel grounded diodes 52 and 54 to protect data exchange link 36 from the high voltage supplied across resistor 24 when switch 34 is closed. Communications control unit 40 exchanges data with fire control system 38 over a serial data line 42. Fire control system 38 also supplies power to communications control unit 40 via a power line 44.

Inside round 20, artillery round communications control system 26 includes a fuze processor 70. In some embodiments of round 20, for example tank ammunition, round 20 consists of a projectile, which is launched from gun 10, and a separate case, which contains the propulsive charge and which remains behind in gun 10 when the projectile is launched. In these embodiments, fuze processor 70 is part of the projectile, and controls the performance and activation (e.g., detonation) of the projectile after the projectile has been launched from gun 10. The remaining components of the system of the present invention that are inside round 20 are operative only before gun 20 is fired and therefore are expendable. Therefore, in embodiments of round 20 with separate projectiles and cases, these remaining components may be included in the case, to minimize the weight of the projectile.

Fuze processor 70 includes a microcontroller 72 and a grounded EEPROM 68. Fuze processor 70 is connected electrically to a communications control system 60, identical to communications control system 40, across a resistor 66. Firing resistor 24 is protected from the voltage level required by communications control system 60 by an amplifier 62 that amplifies low voltage signals from data exchange link 36 to the voltage level required by communications control unit 60 and by an attenuator 64 that attenuates signals, from communications control unit 60 to data exchange link 36, to a voltage level below the "no fire" threshold.

Note that communications control units 40 and 60 both generate signals at voltages that may be above the "no fire" threshold; but the intervening circuitry ensures that the electrical signals that actually cross contacts 14 and 22 and pass through the wires inside the round are below the "no fire" threshold voltage. The purpose of the present invention is to transfer data from fire control system 38 to fuze processor 70, and also to transfer data in the opposite direction, for example, for verification of the type of round 20 and verification that data has been transferred accurately to fuze processor 70.

Communications control unit 60 is powered by a power supply 80 which also is inside round 20. In one embodiment of the present invention, power supply 80 is based on internal batteries, connected in series, to supply the required power to communications control unit 60. An illustrative example of such batteries is the 3 volt lithium batteries commonly used in wristwatches. Such batteries typically have shelf lives of 10 years or more, and can be replaced as necessary.

Figure 3:
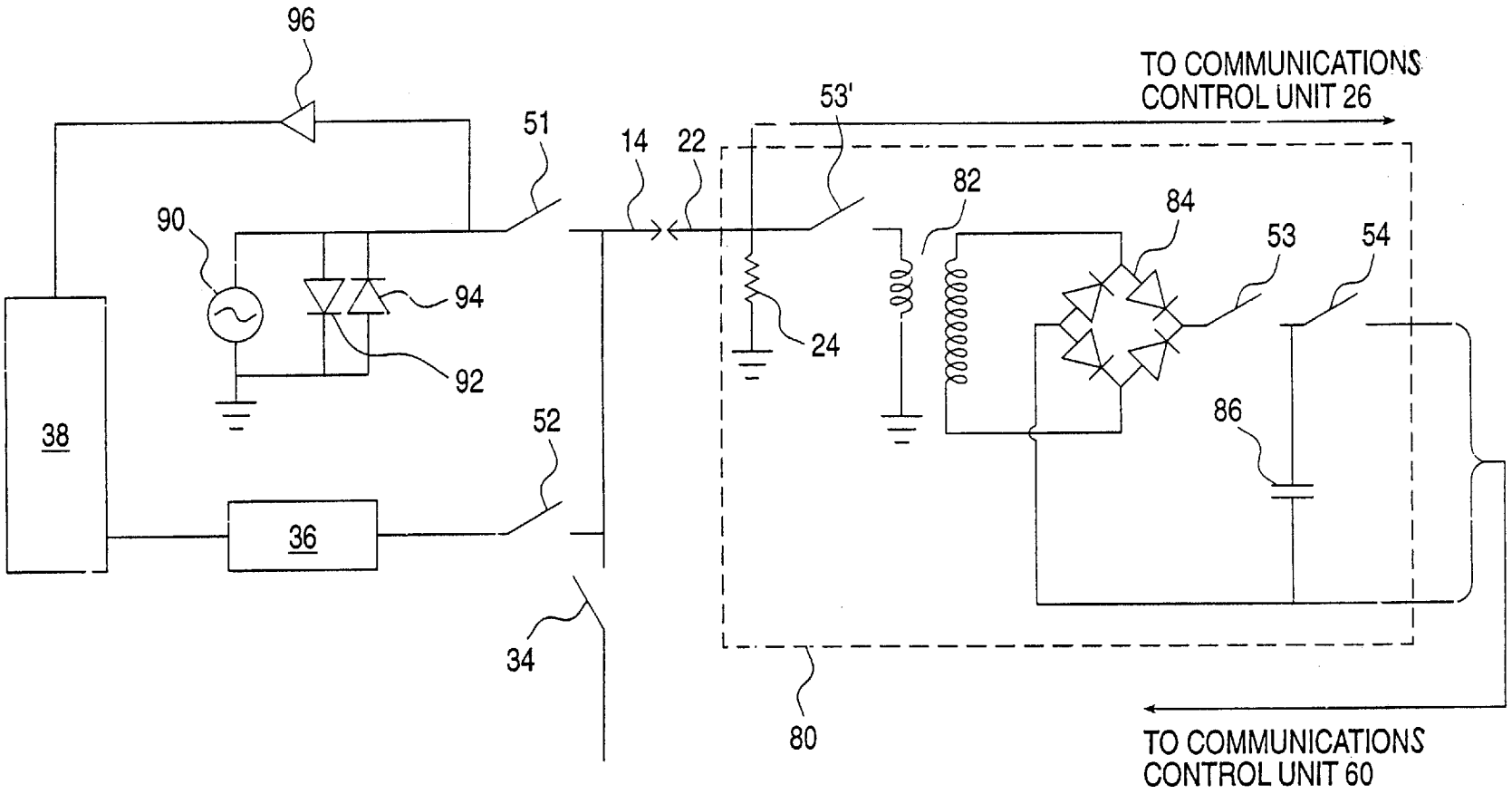
FIG. 3 is a schematic diagram of a power supply.

In another embodiment of the present invention, power supply 80 is as illustrated schematically in FIG. 3. Power supply 80 is connected to contacts 22 in the same way as artillery round communications control system 26. Power supply 80 includes a step-up transformer 82, a diode rectifier 84 and a capacitor 86. One side of diode rectifier 84 is connected to the secondary winding of transformer 82. The other side of diode rectifier 84 is connected to a capacitor 86 via a switch S3. Capacitor 86 is connected to communications control unit 60 via a switch S4. The primary winding of transformer 82 is connected to a switch S3' that is in parallel with firing resistor 24.

Outside of gun 10 is a source 90 of alternating voltage in parallel with two diodes 92 and 94, all in series with a switch S1. When switches S1, S3 and S3' are closed, source 90 provides an alternating voltage that is stepped up by transformer 82 and rectified by diode rectifier 84 to charge capacitor 86. Diodes 92 and 94 ensure that the alternating voltage remains lower than the "no fire" threshold voltage. An amplifier 96 represents a monitor that enables fire control system 38 to verify the signals that cross contacts 14 and 22 when switch S1 is closed. These signals, having been attenuated to ensure that their voltages are below the "no fire" threshold, must be amplified to be monitored by fire control system 38.

In this embodiment of the present invention, after round 20 has been loaded into gun 10, gun 10 is fired in three steps:

Step 1: Charge capacitor 86.

Step 2: Program fuze processor 70 while discharging capacitor 86 to power communications control unit 60.

Step 3: Close trigger switch 34.

The following table shows the positions of switches S1, S2, S3, S3' and S4 during these three steps:

| | S1 | S2 | S3, S3' | S4 |
|---|---|---|---|---|
| Step 1 | closed | open | closed | open |
| Step 2 | closed | closed | open | closed |
| Step 3 | open | X | X | X |

"X" means that the switch may be either open or closed.

The advantage of the second embodiment of power supply 80 over the first embodiment is that in the second embodiment there are no batteries to replace. The disadvantage of the second embodiment of power supply 80 is that it is more complicated than the first embodiment.

In a variant of the embodiment illustrated in FIG. 3, the role of source 90 is played by fire control unit 38, which generates a signal that consists of a binary sequence of 0's and 1's. This square wave signal is used to charge capacitor 86 via transformer 82 and diode rectifier 84.

Some typical parameters of the illustrated system of the present invention are as follows:

| | |
|---|---|
| Resistance of resistor 66 | 1 Ω |
| Maximum voltage applied across contacts 14 and 22 | 0.5 V |
| Voltage supplied via power line 44 | 5 V |
| Capacitance of capacitor 86 | 1000 μF |

While the invention has been described with respect to a limited number of embodiments, it will be appreciated that many variations, modifications and other applications of the invention may be made.

What is claimed is:

1. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor; and (b) a data exchange link, between the fire control system and the contacts of the gun, for applying, to the contacts of the gun, electrical signals representative of data transferred from the fire control system to the fuze processor and for receiving, from the contacts of the gun, electrical signals representative of data transferred from the fuze processor to the fire control system.

2. The data exchange system of claim 1, wherein said data exchange link includes a mechanism for ensuring that said electrical signals, that are applied to the contacts of the gun, have a voltage less than the threshold.

3. The data exchange system of claim 2, wherein said mechanism includes grounded diodes.

4. The data exchange system of claim 2, wherein said mechanism includes an amplifier and an attenuator in parallel.

5. The data exchange system of claim 1, wherein said electrical connection includes a communications control unit.

6. The data exchange system of claim 5, wherein said electrical connection includes an amplifier, for amplifying said signals from the fire control system, and an attenuator, for attenuating electrical signals, from the fuze processor to the fire control system, to a voltage less than the threshold.

7. The data exchange system of claim 5, further comprising:

(c) a power supply, within the round, for said communications control unit.

8. The data exchange system of claim 7, wherein said power supply includes at least one battery.

9. The data exchange system of claim 7, wherein said power supply includes:

(i) a capacitor;

(ii) a transformer; and (iii) a diode rectifier between said transformer and said capacitor;

said transformer being connected in parallel with the resistor.

10. The data exchange system of claim 9, further comprising:

(d) an source of alternating voltage, external to the gun, for providing said alternating voltage to the contacts of the gun, thereby charging said capacitor, said alternating voltage being lower than the threshold.

11. The data exchange system of claim 10, further comprising:

(e) a mechanism for ensuring that said alternating voltage is lower than the threshold.

12. The data exchange system of claim 11, wherein said mechanism for ensuring that said alternating voltage is lower than the threshold includes grounded diodes.

13. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a method for exchanging data between the fuze processor and the fire control system while the round is inside the gun and before firing the gun, comprising the steps of:

(a) providing a data exchange system including:

(i) an electrical connection, within the round, between the contacts of the round and the fuze processor, the resistor being thereby connected in parallel with the fuze processor; and (ii) a data exchange link, between the fire control system and the contacts of the gun, for applying, to the contacts of the gun, electrical signals representative of data to be transferred from the fire control system to the fuze processor;

(b) transferring said data via said data exchange system; and (c) transferring data from the fuze processor to the fire control system via said data exchange system.

14. The method of claim 13, wherein said data exchange link includes a mechanism for ensuring that said electrical signals have a voltage less than the threshold.

15. The method of claim 13, wherein said electrical connection includes a communications control unit, and wherein said data exchange system further includes:

(iii) a power supply, within the round, for powering the communications control unit, said power supply including a capacitor;

the method further comprising the step of:

(c) charging said capacitor.

16. The method of claim 15, wherein said capacitor is connected to the contacts of the round via a transformer and a diode rectifier, said charging being effected by applying an alternating voltage less than the threshold to the contacts of the gun.

17. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor; and (b) a data exchange link, between the fire control system and the contacts of the gun, for applying, to the contacts of the gun, electrical signals representative of data transferred from the fire control system to the fuze processor, said data exchange link including a mechanism for ensuring that said electrical signals have a voltage less than the threshold, said mechanism including an amplifier and an attenuator in parallel.

18. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor said electrical connection including:

(i) a communications control unit, (ii) an amplifier, for amplifying said signals from the fire control system, and (iii) an attenuator, for attenuating electrical signals, from the fuze processor to the fire control system, to a voltage less than the threshold; and (b) a data exchange link, between the fire control system and the contacts of the gun, for applying, to the contacts of the gun, electrical signals representative of data transferred from the fire control system to the fuze processor.

19. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor, said electrical connection including a communications control unit:

(b) a data exchange link, between the fire control system and the contacts of the gun, for applying, to the contacts of the gun, electrical signals representative of data transferred from the fire control system to the fuze processor; and (c) a power supply, within the round, for said communications control unit, said power supply including:

(i) a capacitor, (ii) a transformer, and (iii) a diode rectifier between said transformer and said capacitor, said transformer being connected in parallel with the resistor.

20. The data exchange system of claim 19, further comprising:

(d) an source of alternating voltage, external to the gun, for providing said alternating voltage to the contacts of the gun, thereby charging said capacitor, said alternating voltage being lower than the threshold.

21. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a method for exchanging data between the fuze processor and the fire control system while the round is inside the gun and before firing the gun, comprising the steps of:

(a) providing a data exchange system including:

(i) an electrical connection, within the round, between the contacts of the round and the fuze processor, the resistor being thereby connected in parallel with the fuze processor, said electrical connection including a communications control unit;

(ii) a data exchange link, between the fire control system and the contacts of the gun, for applying, to the contacts of the gun, electrical signals representative of data to be transferred from the fire control system to the fuze processor, and (iii) a power supply, within the round, for powering the communication control unit, said power supply including a capacitor;

(b) transferring said data via said data exchange system; and (c) charging said capacitor.

22. The method of claim 21, wherein said capacitor is connected to the contacts of the round via a transformer and a diode rectifier, said charging being effected by applying an alternating voltage less than the threshold to the contacts of the gun.

23. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor; and (b) a data exchange link, between the fire control system and the contacts of the gun, for applying, to the contacts of the gun, electrical signals representative of data transferred from the fire control system to the fuze processor, said data exchange link including a mechanism for ensuring that said electrical signals have a voltage less than the threshold.

24. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor, said electrical connection including a communications control unit; and (b) a data exchange link, between the fire control system and the contacts of the gun, for applying, to the contacts of the gun, electrical signals representative of data transferred from the fire control system to the fuze processor.

25. In a weapons system in which a round having a case is fired from a gun, the round including a fuze processor, the round further including a firing circuit having a resistor and also having two contacts in the case of the round, the gun having two contacts which contact the two contacts of the round when the round is in the gun and ready to fire, the gun being fired by applying a voltage in excess of a certain threshold to the contacts of the round via the contacts of the gun, the weapons system including a fire control system outside the gun:

a data exchange system for exchanging data between the fuze processor and the fire control system, comprising:

(a) an electrical connection, within the round, between the contacts of the round and the fuze processor, the resistor being thereby connected in parallel with the fuze processor, said electrical connection including:

(i) an amplifier, for amplifying said signals from the fire control system, and (ii) an attenuator, for attenuating electrical signals, from the fuze processor to the fire control system, to a voltage less than the threshold; and (b) a data exchange link, between the fire control system and the contacts of the gun, for applying, to the contacts of the gun, electrical signals representative of data transferred from the fire control system to the fuze processor.

* * * * *